US005680928A

United States Patent [19]

Carr

[11] Patent Number: 5,680,928

[45] Date of Patent: Oct. 28, 1997

[54] JEWELRY STORAGE APPARATUS

[76] Inventor: Loren W. Carr, 402 W. 9th St., Morris, Minn. 56267

[21] Appl. No.: 351,830

[22] Filed: Dec. 8, 1994

[51] Int. Cl.[6] ..... B65D 73/00

[52] U.S. Cl. ..... 206/6.1; 206/806

[58] Field of Search ..... 206/6.1, 495, 460, 206/477, 478, 483, 806; 211/86, 89, 113

[56] References Cited

U.S. PATENT DOCUMENTS

| | | | |
|---|---|---|---|
| 1,639,672 | 8/1927 | Schraysshuen | 206/495 X |
| 2,706,632 | 4/1955 | Chandler | 211/113 X |
| 4,327,837 | 5/1982 | Ross . | |
| 4,749,604 | 6/1988 | Foster . | |
| 4,767,011 | 8/1988 | Butler . | |
| 4,799,587 | 1/1989 | Desanto . | |
| 5,050,745 | 9/1991 | Sanders . | |
| 5,054,624 | 10/1991 | Camp . | |
| 5,117,988 | 6/1992 | Daniels . | |
| 5,141,113 | 8/1992 | Elliott | 206/495 X |
| 5,176,263 | 1/1993 | Caruso . | |
| 5,363,953 | 11/1994 | Carter | 206/495 X |

*Primary Examiner*—Jacob K. Ackun

*Attorney, Agent, or Firm*—Merchant, Gould, Smith, Edell, Welter & Schmidt

[57] ABSTRACT

A jewelry storage apparatus includes cards which have jewelry retainers mounting thereon. The cards typically have attachments which include a flexible member and an attachment portion connected by a flexible member to mount upon the storage card. The flexible member typically has a slit formed therethrough which opens when the member is compressed and closes up when released. Hooks are insertable into these slits to retain and organize the jewelry.

7 Claims, 4 Drawing Sheets

JEWELRY STORAGE APPARATUS

BACKGROUND OF THE INVENTION

1. Field of the Invention

The present invention is directed to an apparatus for organizing, supporting and storing jewelry and other articles.

2. Description of the Prior Art

Jewelry storage devices or organizers are well known. Jewelry boxes have existed for hundreds of years and generally include compartments or trays to hold and, to a limited degree, organize various pieces of jewelry. However, jewelry boxes typically provide very limited organization, as pieces are mixed together and often become entangled with other pieces. In addition, there is much difficulty in separating the pieces and keeping certain pieces of jewelry such as earrings in pairs. Compartments often do not fit to the size of the jewelry, requiring oversize compartments and larger than needed jewelry boxes.

In response to these shortcomings, other devices have been created to organize and store jewelry by retaining and supporting pieces rather than forming compartments. Although these devices do provide some improvement, they do not solve all the problems associated with jewelry organization. Such devices typically do not provide the flexibility required to support various types of jewelry, for example clip-on earrings, pierced style earrings, necklaces, pins, bracelets and rings. Each device may require a different type of support for efficient space utilization. Furthermore, the devices do not provide for storing the various types of jewelry in a well organized manner with a minimum amount of space. Furthermore, these devices do not provide for easily rearranging and moving pieces while supporting and organizing jewelry as storage and organizational needs change.

It can be seen then, that a storage and organizational system for jewelry and other articles is needed which provides for organized storage and separation of individual pieces. In addition, such a device should be adaptable for storing various types of jewelry in various manners. Such a device should also be flexible enough to vary and/or expand with the changing needs of the user. The present invention addresses these as well as other problems associated with jewelry storage and organization.

SUMMARY OF THE INVENTION

The present invention is directed to a storage and organizing apparatus, and in particular to an apparatus for organizing and storing jewelry. According to the preferred embodiment of the present invention, a card is utilized which has hook and loop type fastener Velcro® material mounted on the surface thereof. Mounting members have a material which engages the hook and loop fasteners. Alternatively, the members may have hook and loop fasteners mounted thereon which engage a suitable mating material on the card.

The mounting members are part of retaining devices which include a retaining member. The retaining member is attached to the mounting member with a flexible connection such as a cord, chain or swivel. The retaining members are rubber or plastic flexible compressible members which include a slit formed therein. In their natural state, the members close up the slit so that there is no space and any elements inserted therein will be engaged and held by the sides of the slit. However, when compressed, the slit widens so that members may be inserted therein or removed.

The retainer members are preferably made of a material which will retain their shape and close up the slits in the uncompressed state. In addition, the retainers may have hook members which insert into the slits and may be used for retaining certain types of jewelry or articles. For example, rings or hoop type earrings may not be insertable through the slit but may be retained on a hook. In the preferred embodiment, the hook may take on several configurations including a j-type hook or a pigtail type hook. In this manner, certain types of articles may be placed into the slit of a retainer member for being supported. Other articles may require a hook to retain them. Furthermore, several of the retainers may be combined for retaining articles. For example, necklaces may require two or three retainers having hook members therein to loop through the necklace at several points and to spread it outward and preferably stretched taut for storage flat against the surface of the card. In addition, longer items, such as necklaces can be looped around the hooks several times to decrease space required. It can be appreciated that some articles may require different combinations of hooks and retainers for improved storage.

The cards may be arranged in a larger holder apparatus in one embodiment and hung on a center post which may be rotated. This allows for examination of both sides of the card by rotating the cards until the desired card comes into sight.

It can be appreciated that with the present invention, a flexible and efficient system for storing and organizing jewelry and other articles is achieved. As needs change and grow, the system is able to expand and modify to the storage needs. A supply of retainers and hooks may be kept and can be added to meet the changing needs of the storage system.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
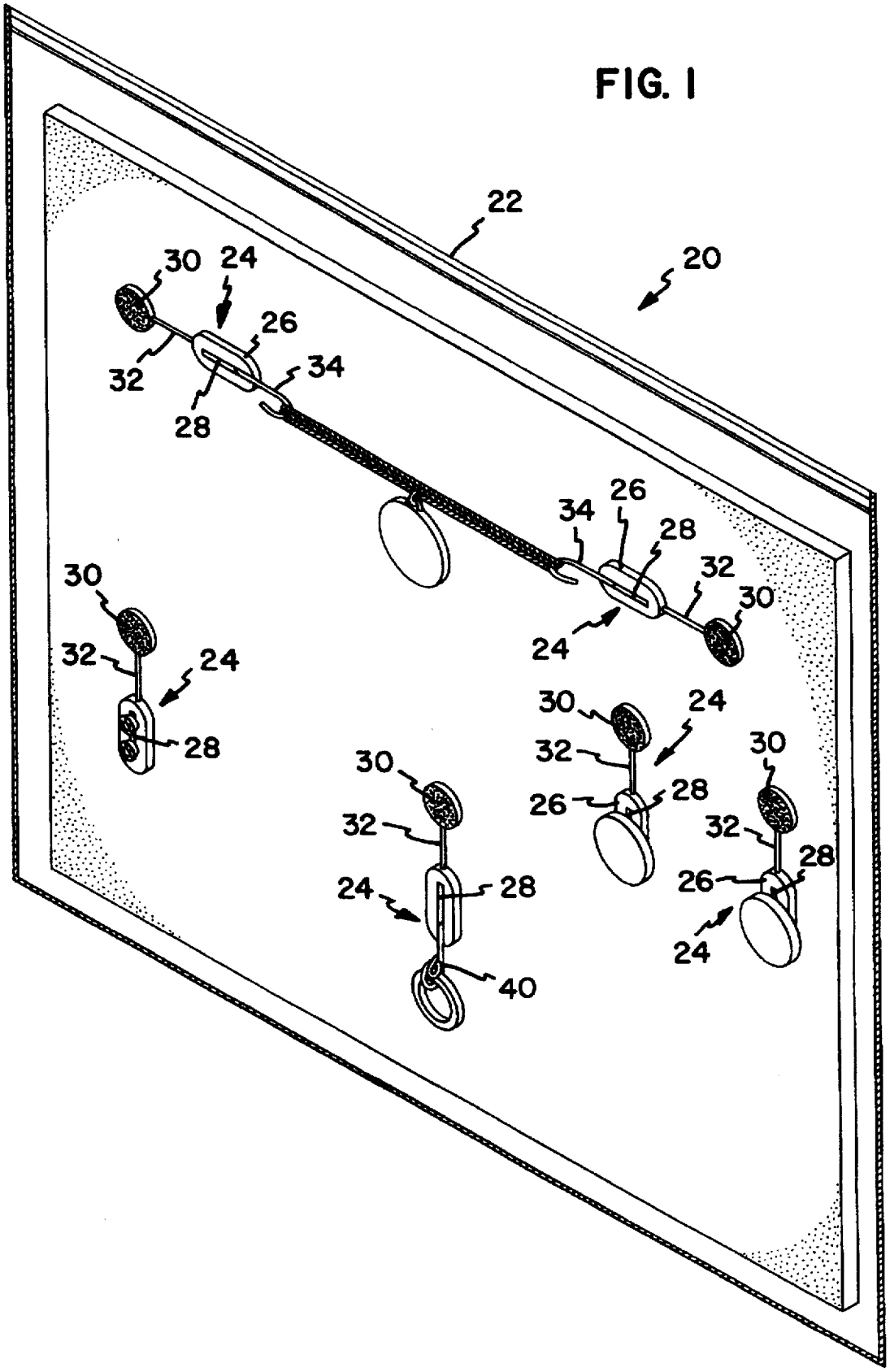
FIG. 1 shows a perspective view of a first embodiment of a jewelry storage apparatus according to the principles of the present invention.

Referring now to the drawings, wherein like reference numerals designate corresponding structure throughout the views, and referring in particular to FIG. 1, there is shown a jewelry storage card device, generally designated 20. The card 20 is used in the present invention to store and organize jewelry and other articles. The card 20 may include a cover portion 22 for travel. The storage device 20 holds a plurality of retainers 24 mounted on the card surface which support jewelry pieces.

Figure 2:
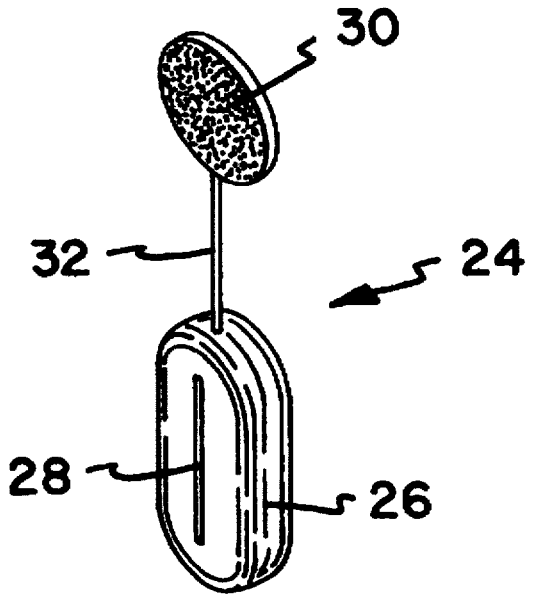
FIG. 2 shows a perspective view of a retainer device for the storage apparatus shown in FIG. 1.
Figure 3:
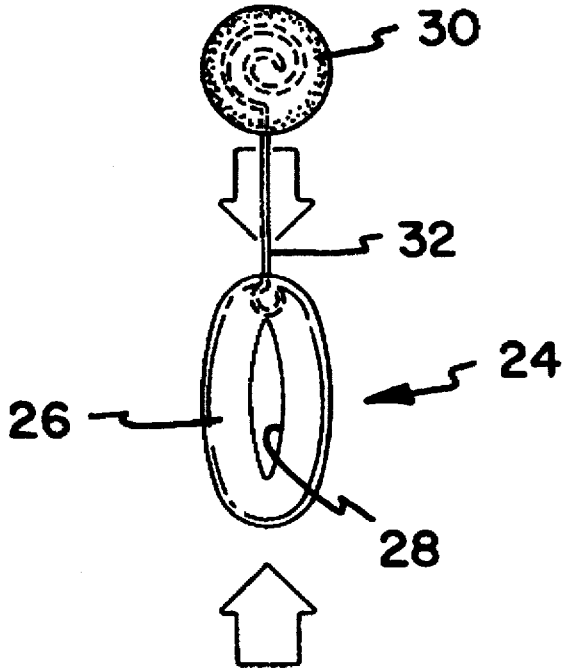
FIG. 3 shows a front elevational view of the retainer device shown in FIG. 2 with the flexible member compressed.

As shown in FIGS. 2 and 3, the retainers 24 include a flexible retainer member 26 which holds jewelry and other articles that insert through a slit 28 formed in the flexible member 26, as explained hereinafter. As shown in FIG. 3, the flexible retainer member 26 is a flexible plastic or rubber member in the preferred embodiment, which may be compressed to widen the slit 28. In addition, an attachment member 30, such as a button mounts to the card 20. A flexible connecting member 32 extends from the retainer member 26 to the attachment member 30. The attachment member 30 may include hook and loop fasteners, commonly known as Velcro®, for attaching to a cloth surface of the storage device 20. It can be appreciated that the reverse arrangement may be used, wherein the storage device 20 includes a hook and loop fastener surface and the attachment member 30 includes a compatible cloth surface. The connecting member 32 may take on several forms such as a filament, chain or swivel, but allows flexibility between the attachment member 30 and the retainer member 26. In addition to flexibility, rotation should be provided so that the attachment member 30 may be mounted so that any jewelry or other articles may be retained in an efficient manner by the retainer member 26, preferably flat against the surface of the storage card 20.

Figure 4:
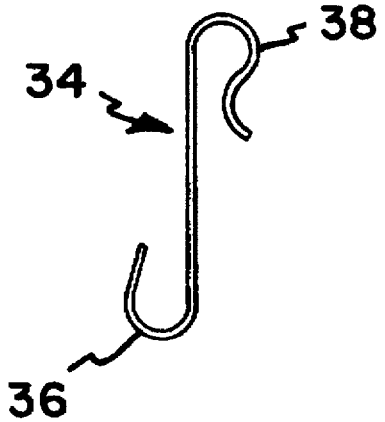
FIG. 4 shows a side elevational view of a hook for the retainer device shown in FIG. 2.
Figure 5:
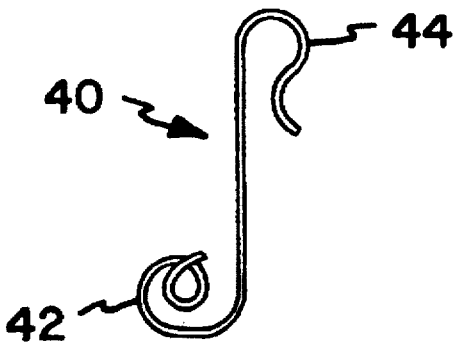
FIG. 5 shows a side elevational view of a second embodiment of a hook for the retainer device shown in FIG. 2.

As shown in FIGS. 4 and 5, the retainer 24 may include hook portions 34 and 40. As shown in FIG. 1, these may be inserted into the retainer member 26 to hold and organize jewelry. The widening of the opening 28 provides for placement of the hooks 34 and 40 into the slit for holding and retaining jewelry and other articles. The hook 34 is a J-shaped hook with an end hook portion 36 and a retainer hook 38. The hook member 40 is a pigtail type hook and includes a curled hook portion 42 and a retainer hook portion 44. The retainer hook portions 38 and 44 are configured to insert into the widened slit 28 in the retainer member 26. When the retainer member 26 is released, the opening 28 closes up and the hooks 34 or 40 are held by the sides of the retainer member 26.

Figure 6:
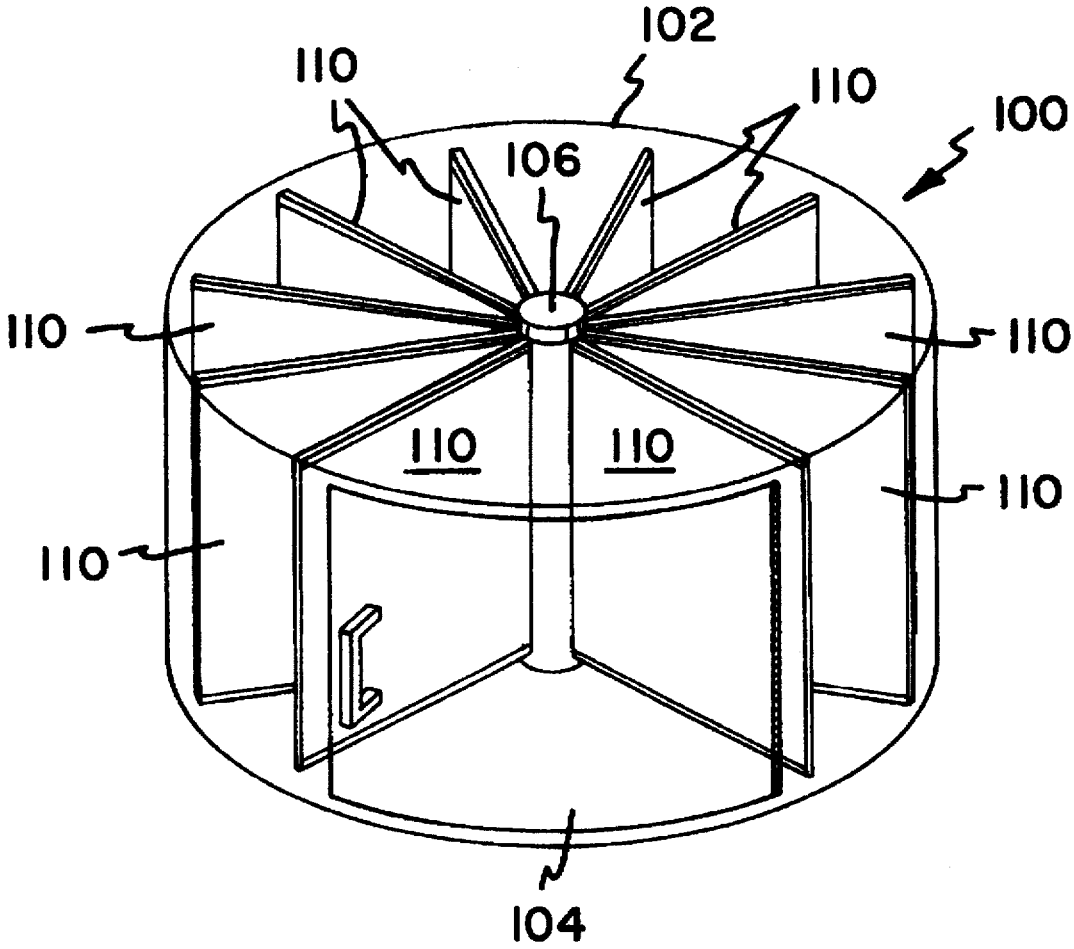
FIG. 6 shows a perspective view of a second embodiment of a storage apparatus; and, FIG. 7 shows a perspective view of a storage card for the storage apparatus shown in FIG. 6.
Figure 7:
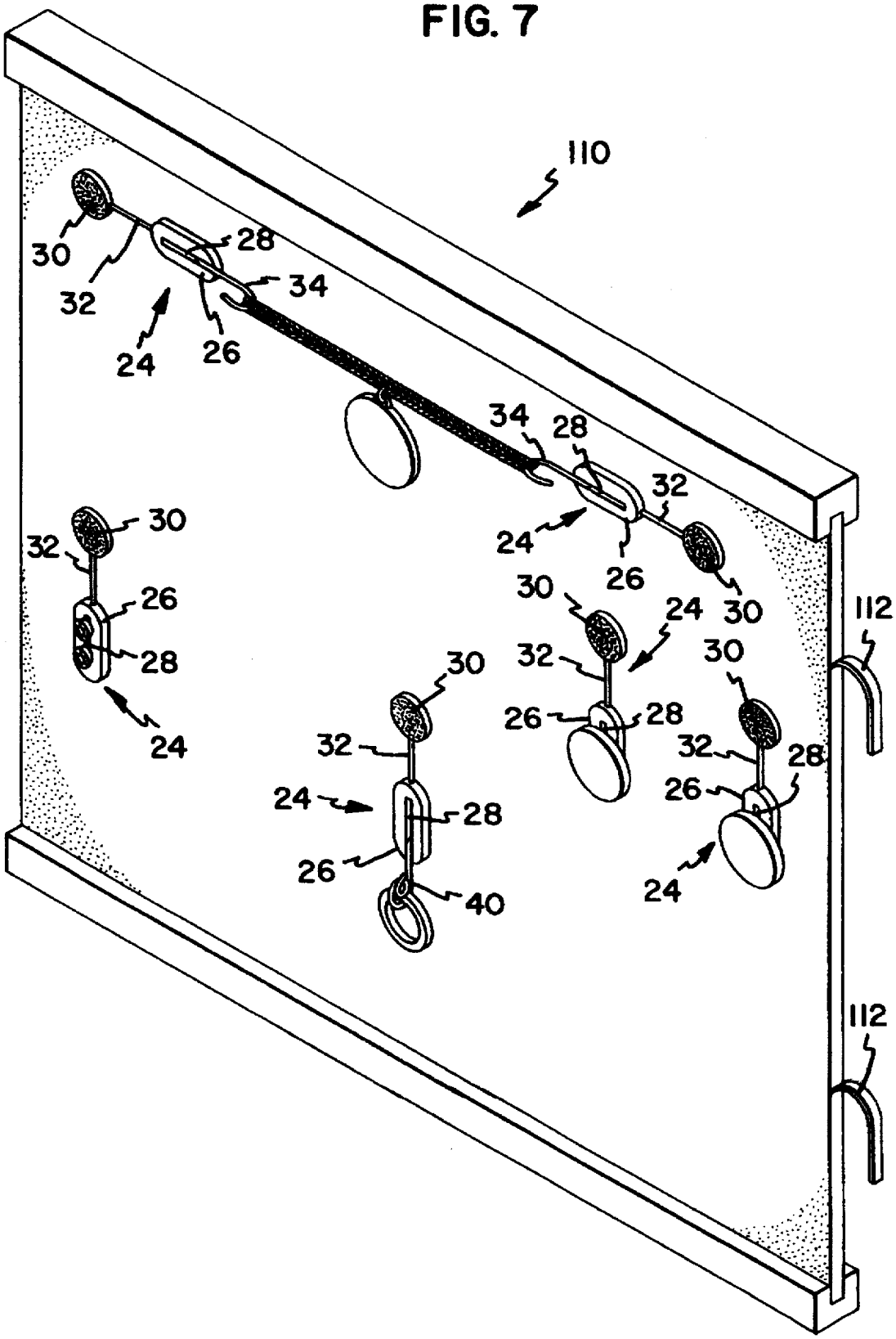

Referring now to FIG. 6, there is shown a second embodiment of a storage apparatus, generally designated 100. The storage apparatus 100 is configured for storing jewelry and other articles on storage cards 110, as shown in FIG. 7. The storage apparatus 100 includes a clear cover 102 which includes a door 104 for accessing the cards. The storage cards 110 are hung on hooks 112 on a center post 106 which rotates so that different cards may be accessed through the door 104. The hooks 112 allow for removing of the cards 110. In addition, the hooks 112 provide pivot points so that the cards may be spread for examination of the articles. It can be appreciated that other storage devices for storing several cards 110 may be utilized. For example, tower or rack configurations may be utilized which have slots for accepting cards.

Referring again to FIGS. 1 and 7, the storage cards 20 and 110 allow for flexibility for placing and supporting jewelry and similar articles. It can be appreciated that for some types of jewelry and other articles, two or more retainers 24 may be utilized to support and organize the articles. With other types of articles, such as earrings, a single retainer 24 may be required for a pair of studs. For other articles, a pair of retainer members 26 may be needed, one for each earring. While still for other articles, a retainer member 26 with a hook 40 or a hook 44 may be utilized to support and retain the articles. Furthermore, two or even more retainers 24, each having a hook 40 or 44 may also be utilized to support or organize some types of articles. Longer items should be pulled taut to reduce the likelihood of tangling and may be looped several times to reduce the area required for storage. Combinations of retainers 24 with and without hooks 40 or 44 might also be used.

It can be appreciated, with the present invention, a simple system is provided for storing and organizing jewelry and other articles. The retainer members 26 may be arranged to minimize the amount of space required and to prevent overlap between pieces. In addition, very little space is required for storing the articles. Great flexibility is provided as the retainer members may be employed in a variety of configurations. In addition, for the storage cards 20 and 110, the jewelry may be stored on both sides.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for supporting jewelry and the like, comprising:

a base:

a jewelry support device comprising:

pliable retainer member including a slit formed therethrough, wherein the retainer member is formed so as to close the slit in a noncompressed position and to spread open when compressed; and attachment means for removably attaching the jewelry support device to the base.

2. An apparatus according to claim 1, wherein the retainer member is configured so that compressing the retainer member widens the opening.

3. An apparatus for supporting jewelry and the like, comprising:

a mounting card;

a jewelry support device, comprising:

a compressible pliable member including an orifice formed therein, wherein the orifice opens upon compressing the member and closes in an uncompressed state;

means for removably attaching the pliable member to the mounting card.

4. An apparatus according to claim 3, comprising a plurality of removable mounting cards.

5. An apparatus according to claim 3, further comprising hook members including an attachment end configured for inserting into the orifice of the compressible pliable members and a retainer end.

6. An apparatus according to claim 5, wherein the retainer end comprises a J-type hook.

7. An apparatus according to claim 5, wherein the retainer end comprises a pigtail type hook.

* * * * *